US006035934A

United States Patent [19]

Stevenson et al.

[11] Patent Number: 6,035,934

[45] **Date of Patent: *Mar. 14, 2000**

[54] METHOD AND SYSTEM FOR SEPARATING AND INJECTING GAS IN A WELLBORE

[75] Inventors: Mark D. Stevenson; Jerry L. Brady; John M. Klein; James L. Cawvey, all of Anchorage, Ak.

[73] Assignee: Atlantic Richfield Company, Los Angeles, Calif.

[ * ] Notice: This patent is subject to a terminal disclaimer.

[21] Appl. No.: 09/028,624

[22] Filed: Feb. 24, 1998

[51] Int. Cl.[7] ..... E21B 43/38

[52] U.S. Cl. ..... 166/265; 166/169; 166/306

[58] Field of Search ..... 166/265, 105.5, 166/105.6, 169, 306, 369

[56] References Cited

U.S. PATENT DOCUMENTS

| | | | |
|---|---|---|---|
| 4,378,047 | 3/1983 | Elliott et al. | 166/68 |
| 4,531,584 | 7/1985 | Ward | 166/265 |
| 4,531,593 | 7/1985 | Elliott et al. | 175/71 |
| 4,610,793 | 9/1986 | Miller | 210/767 |
| 4,981,175 | 1/1991 | Powers | 166/265 |
| 4,995,456 | 2/1991 | Cornette et al. | 166/51 |
| 5,343,945 | 9/1994 | Weingarten et al. | 166/105.5 |
| 5,385,446 | 1/1995 | Hays | 415/202 |
| 5,431,228 | 7/1995 | Weingarten et al. | 166/357 |
| 5,450,901 | 9/1995 | Ellwood | 166/266 |
| 5,482,117 | 1/1996 | Kolpak et al. | 166/265 |
| 5,605,193 | 2/1997 | Bearden et al. | 166/370 |
| 5,730,871 | 3/1998 | Kennedy et al. | 210/512.2 |
| 5,794,697 | 8/1998 | Wolflick et al. | 166/265 |

OTHER PUBLICATIONS

"Slim Phase 4™", Sperry–Sun Drilling Services, 1994, 1995.

"New Design Expands Success of Slim Phase 4™ MWD Resistivity Tool", Sperry Sun Drilling Services, Fall 1995.

"Improved Production Log Interpretation in Horizontal Wells Using Pulsed Neutron Logs", by J.L. Brady, J.J. Kohring and R.J. North, 1996.

"Glossary of Terms & Expressions Used in Well Logging", Second Edition, Society of Professional Well Log Analysis, Oct. 1984.

"Jet Pumping" by Hal Petrie.

"Development and Testing of Compact Liquid–Gas Auger Partial Separator for Downhole or Surface Applications", SPE Production & Facilities, Feb. 1997.

*Primary Examiner*—William Neuder
*Assistant Examiner*—Sunil Singh
*Attorney, Agent, or Firm*—F. Lindsey Scott

[57] ABSTRACT

A method and system for increasing oil production from an oil well producing a mixture of oil and gas through a wellbore penetrating an oil-bearing formation containing an oil-bearing zone and a selected injection zone, by driving a turbine in the oil well with the mixture of oil and gas; separating at least a portion of the gas from the mixture of oil and gas in the oil well to produce a separated gas and an oil-enriched mixture; driving a compressor with the turbine to compress at least a portion of the separated gas in the oil well to a pressure greater than a pressure in the selected injection zone to produce a compressed gas; injecting the compressed gas into the selected injection zone; and recovering at least a major portion of the oil-enriched mixture.

19 Claims, 3 Drawing Sheets

METHOD AND SYSTEM FOR SEPARATING AND INJECTING GAS IN A WELLBORE

FIELD OF THE INVENTION

This invention relates to a method for increasing oil production from oil wells producing a mixture of oil and gas through a wellbore penetrating an oil bearing formation containing a gas cap zone and an oil bearing zone by separating and compressing a portion of the gas prior to producing the mixture of oil and gas from the wellbore, and injecting the compressed gas into the gas cap zone.

BACKGROUND OF THE INVENTION

In many oil fields the oil bearing formation comprises a gas cap zone and an oil bearing zone. Many of these fields produce a mixture of oil and gas with the gas to oil ratio (GOR) increasing as the field ages. This is a result of many factors well known to those skilled in the art. Typically the mixture of gas and oil is separated into an oil portion and a gas portion at the surface. The gas portion may be marketed as a natural gas product, injected to maintain pressure in the gas cap or the like. Further, many such fields are located in parts of the world where it is difficult to economically move the gas to market therefore the injection of the gas preserves its availability as a resource in the future as well as maintaining pressure in the gas cap.

Wells in such fields may produce mixtures having a GOR of over 25,000 SCF/STB. In such instances, the mixture may be less than 1% liquids by volume in the well. Typically a GOR from 1,000 to 4,000 SCF/STB is more than sufficient to carry the oil to the surface as a gas/oil mixture. Normally the oil is dispersed as finely divided droplets or a mist in the gas so produced. In many such wells quantities of water may be recovered with the oil. The term "oil" as used herein refers to liquids produced from a formation. The surface facilities for separating and returning the gas to the gas cap obviously must be of substantial capacity when such mixtures are produced to return sufficient gas to the gas cap or other depleted formation to maintain oil production.

Typically, in such fields, gathering lines gather the fluids into common lines which are then passed to production facilities or the like where crude oil and condensate are separated and transported as crude oil. Natural gas liquids are then recovered from the gas stream and optionally combined with the crude oil and condensate. Optionally, a miscible solvent which comprises carbon dioxide, nitrogen and a mixture of light hydrocarbons may be recovered from the gas stream and used for enhanced oil recovery or the like. The remaining gas stream is then passed to a compressor where it is compressed for injection. The compressed gas is injected through injection wells, an annular section of a production well, or the like, into the gas cap.

Clearly the size of the surface equipment required to process the mixture of gas and oil is considerable and may become a limiting factor on the amount of oil which can be produced from the formation because of capacity limitations on the ability to handle the produced gas.

It has been disclosed in U.S. Pat. No. 5,431,228 "Down Hole Gas-Liquid Separator for Wells" issued Jul. 11, 1995 to Weingarten et al and assigned to Atlantic Richfield Company that an auger separator can be used downhole to separate a gas and liquid stream for separate recovery at the surface. A gaseous portion of the stream is recovered through an annular space in the well with the liquids being recovered through a production tubing.

In SPE 30637 "New Design for Compact Liquid-Gas Partial Separation: Down Hole and Surface Installations for Artificial Lift Applications" by Weingarten et al it is disclosed that auger separators as disclosed in U.S. Pat. No. 5,431,228 can be used for downhole and surface installations for gas/liquid separation. While such separations are particularly useful as discussed for artificial or gas lift applications and the like, all of the gas and liquid is still recovered at the surface for processing as disclosed. Accordingly, the surface equipment for processing gas may still impose a significant limitation on the quantities of oil which can be produced from a subterranean formation which produces oil as a mixture of gas and liquids.

Accordingly a continuing search has been directed to the development of methods which can increase the amount of oil which may be produced from subterranean formations producing a mixture of oil and gas with existing surface equipment.

SUMMARY OF THE INVENTION

According to the present invention, it has been found that increased quantities of oil can be produced from an oil well producing a mixture of oil and gas through a wellbore penetrating an oil-bearing formation containing an oil-bearing zone and a selected injection zone, by driving a turbine in the oil well with the mixture of oil and gas; separating at least a portion of the gas from the mixture of oil and gas in the oil well to produce a separated gas and an oil-enriched mixture; driving a compressor with the turbine to compress at least a portion of the separated gas in the oil well to a pressure greater than a pressure in the selected injection zone to produce a compressed gas; injecting the compressed gas into the selected injection zone; and recovering at least a major portion of the oil-enriched mixture.

The invention further comprises a system for increasing oil production from an oil well producing a mixture of oil and gas through a wellbore penetrating a formation containing an oil-bearing zone and a selected injection zone, wherein the system comprises a turbine positioned in the wellbore in fluid communication with the formation to receive and be driven by the mixture of oil and gas; a separator positioned in the wellbore in fluid communication with the turbine and in fluid communication with a surface; and a compressor positioned in the wellbore, drivingly connected to the turbine, and in fluid communication with a gas outlet from the separator, and having a compressed gas discharge outlet.

DESCRIPTION OF THE PREFERRED EMBODIMENT

In the discussion of the Figures, the same numbers will be used to refer to the same or similar components throughout. Not all components of the wells necessary for the operation of the wells have been discussed in the interest of conciseness.

Figure 1:
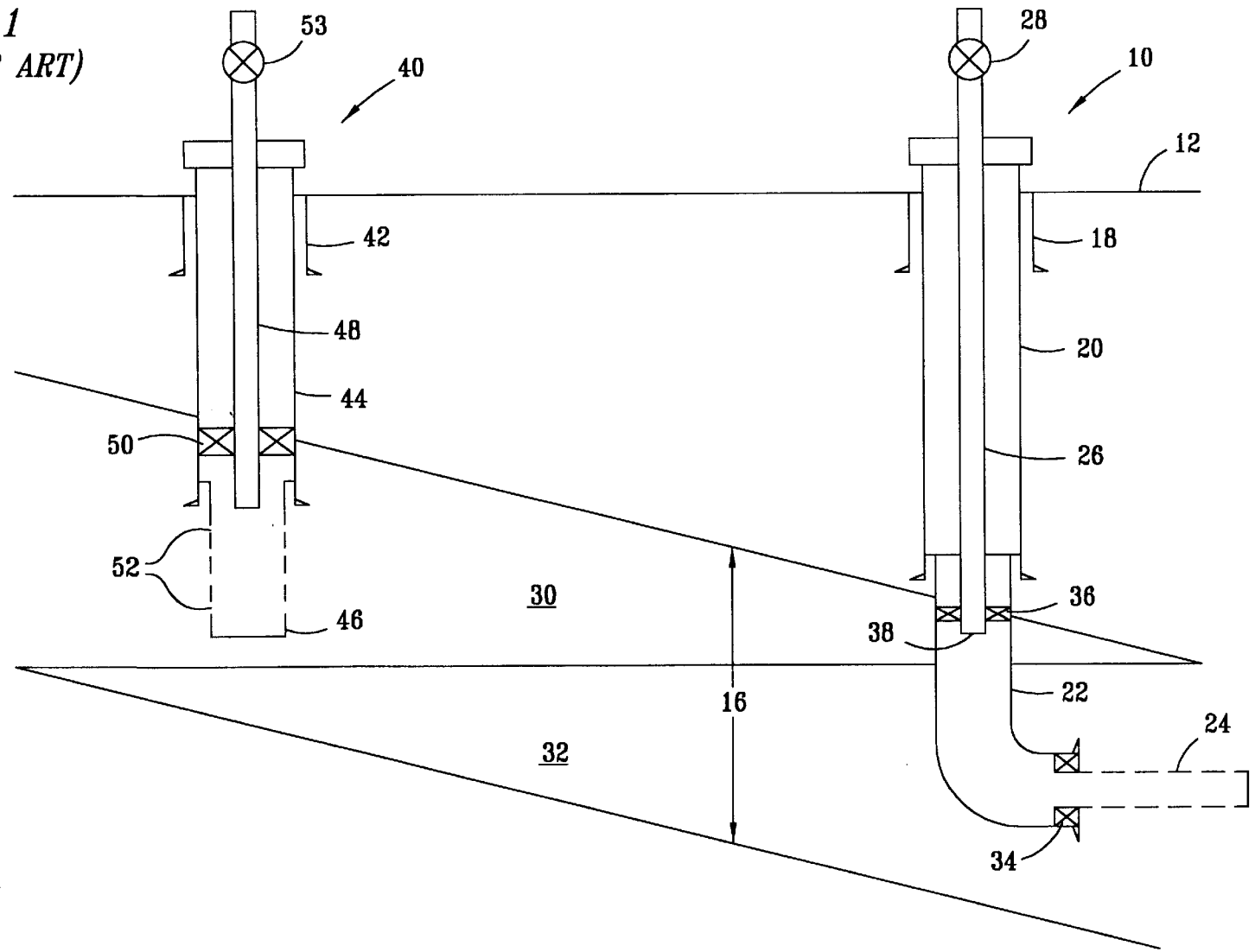
FIG. 1 (PRIOR ART)
FIG. 1 is a schematic diagram of a production well, according to the prior art, for producing a mixture of oil and gas from a subterranean formation and an injection well for injecting gas back into a gas cap in the oil bearing formation.

In FIG. 1, depicting the prior art, a production oil well 10 is positioned in a wellbore (not shown) to extend from a surface 12 through an overburden 14 to an oil bearing formation 16. The production oil well 10 includes a first casing section 18, a second casing section 20, a third casing section 22, and a fourth casing section 24, it being understood that the oil well 10 may alternatively include more or fewer than four casing sections. The use of such casing sections is well known to those skilled in the art for the completion of oil wells. The casings are of a decreasing size and the fourth casing 24 may be a slotted liner, a perforated pipe, or the like. While the production oil well 10 is shown as a well which has been curved to extend horizontally into the formation 16, it is not necessary that the well 10 include such a horizontal section and, alternatively, the well 10 may extend only vertically into the formation 16. Such variations are well known to those skilled in the art for the production of oil from subterranean formations.

The oil well 10 also includes a production tubing 26 for the production of fluids from the well 10. The production tubing 26 extends upwardly to a wellhead 28 shown schematically as a valve. The wellhead 28 contains the necessary valving and the like to control the flow of fluids into and from the oil well 10, the production tubing 26, and the like.

The formation 16 includes a selected injection zone 30 and an oil bearing zone 32 below the selected injection zone. The selected injection zone 30 may be a gas cap zone, an aqueous zone, a portion of the oil bearing zone 32, or a depleted portion of the formation 16. Pressure in the formation 16 is maintained by gas in the selected injection zone 30 and, accordingly, it is desirable in such fields to maintain the pressure in the gas cap zone as hydrocarbon fluids are produced from the formation 16 by injecting gas. The formation pressure may be maintained by water injection, gas injection, or both. The injection of gas requires the removal of the liquids from the gas prior to compressing the gas, and injecting the gas back into the selected injection zone 30. Typically, the GOR of oil and gas mixtures recovered from such formations increases as the level of the oil bearing zone drops as a result of the removal of oil from the oil bearing formation 16.

In the well 10, a packer 34 is used to prevent the flow of fluids in the annular space between the third casing section 22 and the fourth casing section 24. A packer 36 is positioned to prevent the flow of fluids in the annular space between the exterior of the production tubing 26 and the interior of the second casing section 20 and that portion of the interior of the third casing section 22 above the packer 36. Fluids from the formation 16 can thus flow upwardly through the production tubing 26 and the wellhead 28 to processing equipment (not shown) at the surface, as described previously. The well 10, as shown, produces fluids under the formation pressure and does not require a pump.

Also shown in FIG. 1 is an injection well 40 comprising a first casing section 42, a second casing section 44, a third casing section 46, and an injection tubing 48. A packer 50 is positioned between the interior of the casing 44 and the exterior of the tubing 48 to prevent the upward flow of fluid between the tubing 48 and the casing 44. Gas is injected into the selected injection zone 30 through perforations 52 in the third casing section 46. The flow of gases into the well 40 is regulated by a wellhead 53 shown schematically as a valve.

In operation, gas produced from the well 10 is injected into the selected injection zone 30 through the injection well 40. The injected gas thereby maintains pressure in the formation 16 and remains available for production and use as a fuel resource, or for sales or export, at a later date if desired.

In oil wells which produce excessive amounts of gas, the necessity for handling the large volume of gas at the surface can limit the ability of the formation to produce oil. The installation of sufficient gas handling equipment to separate the large volume of gas from the oil for use as a product, or for injection into the selected injection zone 30 can be prohibitively expensive.

Figure 2:
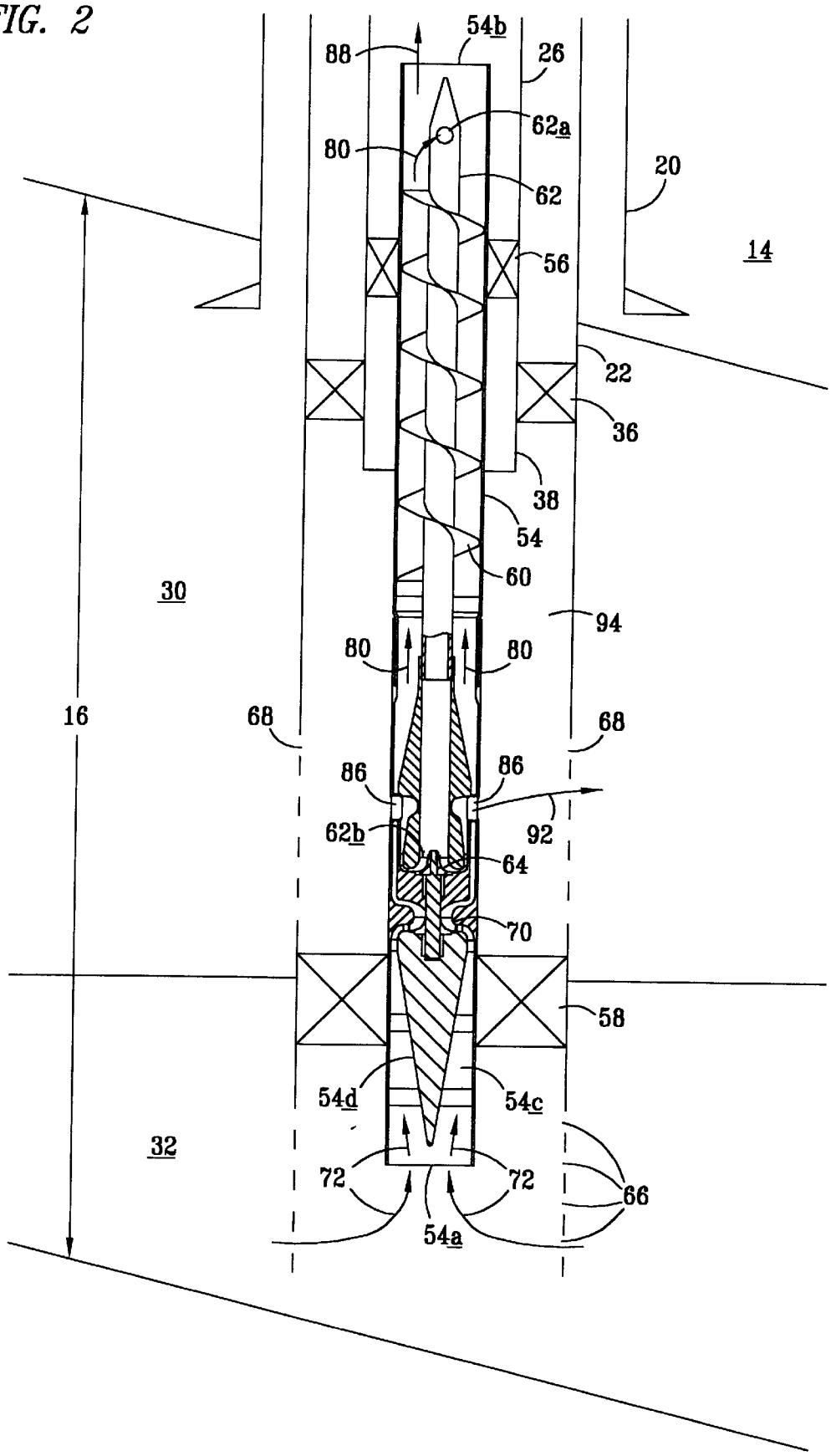
FIG. 2 is schematic diagram of an embodiment of the system of the present invention positioned in an existing wellbore.

In FIG. 2, an embodiment of the present invention is shown which permits the downhole separation and injection of at least a portion of the produced gas, and which permits the production of an oil-enriched mixture of oil and gas. The embodiment shown in FIG. 2 comprises a modification of the production oil well 10 in which a tubular member 54 is positioned in a manner well known to those skilled in the art in a lower end 38 of the production tubing 26. The positioning of such tubular members by wire line or coiled tubing techniques is well known to those skilled in the art and will not be discussed. The tubular member 54 is secured in position with two packers 56 and 58, or nipples with a locking mandrels, positioned between the tubular member 54 and, respectively, the production tubing 26 and the third casing section 22 to prevent the flow of fluids in the annular space between the tubular member 54 and, respectively, the production tubing 26 and the third casing section 22. The tubular member 54 includes an inlet 54*a* and an outlet 54*b* for receiving and discharging, respectively, a stream of fluids.

The tubular member 54 further includes, positioned therein, a downhole separator 60 such as an auger separator (depicted in FIG. 2), a cyclone separator, a rotary centrifugal separator, or the like. Auger separators are more fully disclosed and discussed in U.S. Pat. No. 5,431,228, "Down Hole Gas Liquid Separator for Wells", issued Jul. 11, 1995 to Jean S. Weingarten et al, and in "New Design for Compact-Liquid Gas Partial Separation: Down Hole and Surface Installations for Artificial Lift Applications", Jean S. Weingarten et al, SPE 30637 presented Oct. 22–25, 1995, both of which references are hereby incorporated in their entirety by reference. Such separators are considered to be well known to those skilled in the art and are effective to separate at least a major portion of the gas from a flowing stream of liquid (e.g., oil) and gas by causing the fluid mixture to flow around a circular path thereby forcing heavier phases, i.e., the liquids, outwardly by centrifugal force and upwardly through the outlet 54*b* into the production tubing 26 for recovery at the surface 12. The lighter phases of the mixture, i.e., the gases, are displaced inwardly within the separator, away from the heavier phases, and are thereby separated from the liquids, and flow from the separator 60 through one or more gas inlets 62*a* (only one of which is shown) into a central return tube 62. The central return tube 62 is sealed at the top and is effective for constraining the flow of separated gases to a downwardly direction toward a gas outlet 62*b* of the central return tube 62 into a gas compressor 64 as described more fully below.

A plurality of perforations 66 and 68 are formed in the third casing section 22 for facilitating fluid communication with the oil bearing formation 32 and with the selected injection zone 30, respectively. The tubular member 54 further includes an inlet passageway 54*c* formed about a cone-shaped member 54*d* such that the passageway 54*c* narrows as fluid flows upwardly through it, with the result that such fluids increase in velocity. As shown schematically by arrows 72, the passageway 54*c* is configured to direct a stream of fluids, received from the formation 16 through the perforations 66 and the inlet 54*a*, through a 90° change of direction around a shoulder 54*d*' of the cone-shaped member

54*d* to enter radially into a suitable turbine 70 described in greater detail below.

Figure 3:
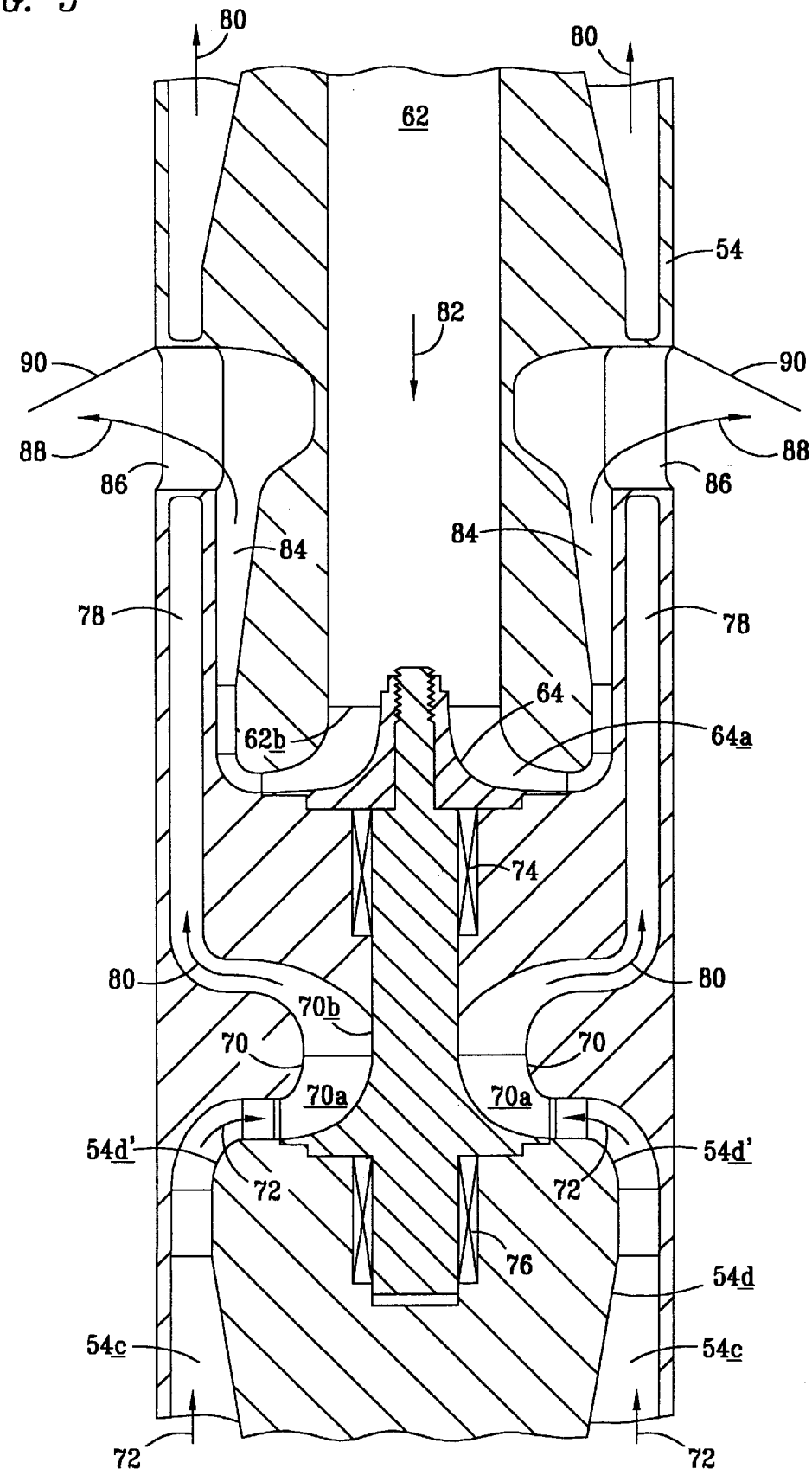
FIG. 3 is an enlargement of a portion of the embodiment of FIG. 2 depicting a turbine positioned below a compressor in an existing wellbore for use in the system of the present invention.

As more clearly shown by the arrows 72 in FIG. 3, the inlet passageway 54*c* is configured to direct fluids (e.g., oil and gas) received therein around the cone-shaped member 54*d* to a plurality of turbine impeller blades 70*a* (only two of which are shown in FIG. 3) mounted to a shaft 70*b* of the turbine 70. The shaft 70*b* is rotatably mounted within the tubular member 54 on suitable upper and lower bearings 74 and 76, respectively, so that the turbine 70 may rotate when the impeller blades 70*a* are impinged with fluid. While the turbine 70 is depicted in FIG. 3 as a radial turbine, any of a number of different types of radial or axial turbines, such as a turbine expander, a hydraulic turbine, a bi-phase turbine, or the like, may be utilized in the present invention. Turbine expanders, hydraulic turbines, and bi-phase turbines are considered to be well known to those skilled in the art, and are effective for receiving a stream of fluids and generating, from the received stream of fluids, torque exerted onto a shaft, such stream of fluids comprising largely gases, liquids, and mixtures of gases and liquids, respectively. Bi-phase turbines, in particular, are more fully disclosed and discussed in U.S. Pat. No. 5,385,446, entitled "Hybrid Two-Phase Turbine", issued Jan. 31, 1995, to Lance G. Hays, which reference is hereby incorporated in its entirety by reference.

As further shown in FIG. 3, a passageway 78 is configured to direct the stream of fluids that exits the plurality of blades 70*a* of the turbine 70 to the separator 60 (FIG. 2), as shown schematically by arrows 80. The separator 60 is configured, as discussed above with respect to FIG. 2, to separate gas from the stream of fluids received into the separator 60 and to return separated gas downwardly, as indicated schematically by an arrow 82, through the central return tube 62 and gas outlet 62*b* and to a plurality of impeller blades 64*a* (only two of which are shown) of the gas compressor 64, such as an axial, radial (shown), or mixed flow compressor, or the like, positioned above the turbine 70 and drivingly connected to the turbine 70 via the shaft 70*b*. A plurality of diffuser passageways 84 (only two of which are shown in FIG. 3) is configured for carrying compressed gas from the compressor 64 to a plurality of discharge outlets 86 (only two of which are shown), as shown schematically by arrows 88, and for diffusing the gas so that the static pressure of the gas in increased as it is discharged through the discharge outlets 86. Check valves 90 are optionally positioned over the discharge outlets 86 to prevent fluids from flowing from the formation 16 (not shown in FIG. 3) into the compressor 64.

In the operation of the device shown in FIGS. 2–3, a mixture of oil and gas flows, as indicated schematically by the arrows 72 in FIG. 2, from the oil-bearing formation 32, through the perforations 66, through the inlet 54*a* and the inlet passageway 54*c* of the tubular member 54, and into the turbine 70. As the mixture flows through the inlet passageway 54*c* and around the cone-shaped member 54*d*, the passageway 54*c* narrows and, as a result, the velocity of the mixture increases until it enters the turbine 70. Referring to FIG. 3, as the oil/gas mixture enters the turbine 70, the mixture impinges the impeller blades 70*a* and imparts rotational motion to the turbine 70, the shaft 70*b*, and the compressor 64. Additionally, as the oil/gas mixture flows through the turbine 70, the pressure and temperature of the mixture decreases, thereby facilitating the separation in the separator 60, discussed below, of additional quantities of liquids from the mixture of oil and gas. As indicated schematically by the arrows 80, the mixture then flows upwardly through the passageway 78 to and through the separator 60 (FIG. 2).

Referring to FIG. 2, as the oil/gas mixture flows through the separator 60, it flows in a circular path thereby forcing the heavier phases of the oil and gas mixture outwardly by centrifugal force to produce an oil-enriched mixture. The oil-enriched mixture flows upwardly through the outlet 54*b*, as shown schematically by an arrow 88, and through the production tubing 26 to the surface 12, where it is recovered through the well head 28 and passed to further gas/liquid separation and the like. The recovered gas may then be injected through an injection well, produced as a gas product, or the like.

The heavier phases of the oil/gas mixture which, in the separator 60, are forced outwardly by centrifugal force, displace the lighter phases of the mixture, such as gas, inwardly toward the central return tube 62. The inwardly displaced gas is recovered through the gas inlet 62*a* of the central return tube 62, as shown schematically by an arrow 80, and passed downwardly through the tube 62 and the gas outlet 62*b* to the compressor 64. As shown more clearly in FIG. 3, as the separated gas flows through the compressor 64, the turbine 70 drives the compressor 64 to compress, i.e., increase the pressure of, the gas. The compressed gas then enters the passageway 84 and is diffused as it moves toward the discharge outlets 86 and through the check valves 90, as shown schematically by the arrows 88, thereby further increasing the static pressure of the gas until the pressure of the gas exceeds the pressure of the gas in the selected injection zone 30. As shown schematically in FIG. 2 by an arrow 92, the gas passes through the discharge outlet 86 into an annular space 94 defined between the tubular member 54 and the third casing section 22, above the packer 58 and below the packer 36. The gas in the annular space 94 continues to flow through the perforation 68 into the selected injection zone 30 of the formation 16.

By the use of the device shown in FIGS. 2–3, a portion of the gas is removed from the oil/gas mixture and injected downhole without the necessity for passing the separated portion of the gas to the surface for treatment. This removal of a significant portion of the gas downhole relieves the load on surface equipment since a smaller volume of gas is produced to the surface. In many fields, GOR values as high as 25,000 SCF/STB are encountered. GOR values from 1,000 to 4,000 SCF/STB are generally more than sufficient to carry the produced liquids to the surface. A significant amount of the gas can thus be removed and injected downhole with no detriment to the production process. This significantly increases the amount of oil which can be recovered from formations which produce gas and oil in mixture which are limited by the amount of gas handling capacity available at the surface.

Still further, by the use of the method and device of the present invention, the entire mixture of oil and gas that flows from the formation 16 through the inlet 54*a* into the tubular member 54 is used to drive the turbine 70 to provide power for the gas compressor 64. As the entire mixture passes through the turbine, the temperature and pressure of the entire mixture is also reduced. As a result, additional hydrocarbon components of the mixture of oil and gas are condensed for separation in the separator 60 and can be recovered at the surface 12 as liquids.

The investment to install the system of the present invention in a plurality of wells to reduce the gas produced from a field is substantially less than the cost of providing additional separation and compression equipment at the surface. It also requires no fuel gas to drive the compression equipment since the pressure of the flowing fluids can be used for this purpose. It also permits the injection of selected quantities of gas from individual wells into a downhole gas cap, from which wells oil production had become limited by reason of the capacity of the lines to carry produced fluids away from the well, thereby permitting increased production from such wells. It can also make certain formations, which had previously been uneconomical to produce from, economical to produce from because of the ability to inject the gas downhole.

Having thus described the present invention by reference to certain of its preferred embodiments, it is noted that the embodiments disclosed are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, what is claimed is:

1. A method for increasing oil production from an oil well producing a mixture of oil and gas through a wellbore penetrating an oil-bearing formation containing an oil-bearing zone and a selected injection zone, the method comprising:

a) driving a turbine in the oil well with the mixture of oil and gas;

b) separating with a separator at least a portion of the gas from the mixture of oil and gas in the oil well to produce a separated gas and an oil-enriched mixture;

c) driving a compressor with the turbine, the compressor and the turbine being positioned in the wellbore beneath the separator to compress at least a portion of the separated gas in the oil well to a pressure greater than a pressure in the selected injection zone to produce a compressed gas;

d) injecting the compressed gas into the selected injection zone; and e) recovering at least a major portion of the oil-enriched mixture.

2. The method of claim 1 wherein the turbine is positioned below the compressor.

3. The method of claim 1 wherein the step of separating is performed using a separator positioned in the wellbore above the compressor, the compressor being positioned above the turbine.

4. The method of claim 1 wherein the step of separating is performed using a separator selected from a group of separators consisting of an auger separator, a cyclone separator, and a rotary centrifugal separator.

5. The method of claim 1 wherein the turbine is selected from a group of turbines consisting of a turbine expander, a hydraulic turbine, and a bi-phase turbine.

6. The method of claim 1 wherein the steps of driving, separating, and compressing are performed in a tubular member in fluid communication with the oil-bearing formation and with a tubing member extending to a surface.

7. The method of claim 1 wherein the selected injection zone is selected from one of a gas cap zone, an aqueous zone, the oil bearing zone, and a depleted portion of the formation.

8. A system for increasing the production of oil from a production oil well producing a mixture of oil and gas through a wellbore penetrating a formation containing an oil-bearing zone and a selected injection zone, the system comprising:

a) a turbine positioned in the wellbore in fluid communication with the formation to receive and be driven by the mixture of oil and gas;

b) a separator positioned in the wellbore in fluid communication with the turbine and in fluid communication with a surface; and c) a compressor positioned in the wellbore, drivingly connected to the turbine, the compressor and the turbine being positioned in the wellbore beneath the separator, and in fluid communication with a gas outlet from the separator, and having a compressed gas discharge outlet.

9. The system of claim 8 further comprising a discharge passageway in fluid communication with the discharge outlet from the compressor and in fluid communication with the selected injection zone.

10. The system of claim 8 wherein the turbine, separator, and compressor are positioned in a tubular member positioned in the wellbore.

11. The system of claim 8 wherein the turbine, separator, and compressor are positioned in a tubular member positioned in a tubing string extending to the surface.

12. The system of claim 8 wherein the separator is selected from a group of separators consisting of an auger separator, a cyclone separator, and a rotary centrifugal separator.

13. The system of claim 8 wherein the turbine is selected from a group of turbines consisting of a turbine expander, a hydraulic turbine, and a bi-phase turbine.

14. The system of claim 8 wherein the discharge outlet comprises a check valve to prevent the flow of fluids from the formation into the compressor through the discharge passageway.

15. The system of claim 8 wherein the turbine is positioned below the compressor and the separator.

16. The system of claim 8 wherein the turbine is positioned below the compressor, and the compressor is positioned below the separator.

17. The system of claim 8 wherein the selected injection zone is one of a gas cap zone, an aqueous zone, the oil bearing zone, and a depleted portion of the formation.

18. The system of claim 8 wherein the compressor is selected from a group of compressors consisting of axial, radial, and mixed flow compressors.

19. A system for increasing the production of oil from a production oil well producing a mixture of oil and gas through a wellbore penetrating a formation containing an oil-bearing zone and a selected injection zone, the system comprising:

a) a tubular member positioned in the wellbore in fluid communication with a production tubing in fluid communication with a surface and with the formation;

b) a turbine positioned in the tubular member and in fluid communication with the formation to receive and be driven by the mixture of oil and gas;

c) a separator positioned in the tubular member and in fluid communication with the turbine and in fluid communication with the surface;

d) a compressor positioned in the wellbore, drivingly connected to the turbine, the compressor and the turbine being positioned and in fluid communication with a gas outlet from the separator, and having a compressed gas discharge outlet the compressor and the turbine being positioned in the wellbore beneath the separator; and e) a cone-shaped member positioned in the tubular member below the turbine to increase the velocity of the mixture of oil and gas passed to the turbine.

* * * * *